US005368364A

United States Patent [19]

Kanai

[11] Patent Number: 5,368,364

[45] Date of Patent: Nov. 29, 1994

[54] CHAIR WITH ARMRESTS

[75] Inventor: Hiroshi Kanai, Kawasaki, Japan

[73] Assignee: Uchida Yoko Co., Ltd., Tokyo, Japan

[21] Appl. No.: 7,799

[22] Filed: Jan. 22, 1993

[30] Foreign Application Priority Data

Sep. 28, 1992 [JP] Japan ..... 4-230493

[51] Int. Cl.[5] ..... A47C 7/54

[52] U.S. Cl. ..... 297/411.27; 297/440.1

[58] Field of Search ..... 297/411.27, 411.26, 297/440.16, 440.21, 440.1

[56] References Cited

U.S. PATENT DOCUMENTS

| | | | |
|---|---|---|---|
| 311,854 | 2/1885 | Roush | 297/440.1 |
| 2,865,430 | 12/1958 | Folkner | 297/411.27 |
| 3,036,864 | 5/1962 | Arai | 297/440.16 |
| 3,989,298 | 11/1976 | Cycowicz | 297/440.21 |
| 3,990,745 | 11/1976 | Rodaway | 297/440.16 |
| 4,707,026 | 11/1987 | Johansson | 297/411.27 |
| 4,750,784 | 6/1988 | Schwartz | 297/440.21 |

FOREIGN PATENT DOCUMENTS

| | | | |
|---|---|---|---|
| 2148422 | 5/1985 | United Kingdom | 297/411.26 |

*Primary Examiner*—Kenneth J. Dorner
*Assistant Examiner*—David E. Allred
*Attorney, Agent, or Firm*—Beveridge, DeGrandi, Weilacher & Young

[57] ABSTRACT

A chair with freely attachable and removable armrests comprises a basic chair unit wherein a leg and a back rest portion attached to a frame on a lower surface of a seat portion, the two ends of the lower surface in the lateral direction of the seat portion being provided with armrest attachment portions. An attachment end portion provided at the lower end of each armrest comprises a positioning protrusion portion that can be inserted into a positioning hole provided in an internal portion of one of the armrest attachment portions. An attachment base portion (spacer) is positioned and held in close contact with guide surfaces along a guide portion of the armrest attachment portion, and a removal-prevention element in the armrest attachment portion is provided for preventing the removal of the attachment end portion. Thus, armrests can be removed from the basic chair unit by a simple operation.

6 Claims, 12 Drawing Sheets

CHAIR WITH ARMRESTS

BACKGROUND OF THE INVENTION

The present invention relates to a chair designed mainly for office use, and, in particular, to a chair with armrests wherein the armrests can be freely attached and removed as required.

A chair used in an office or similar environment consists of a chair (a) comprising a seat portion (b) with armrests (c) on either side thereof, for resting the elbows, as shown in FIG. 23 and described in, for example, Japanese Patent Laid-Open Publication (KOKAI) Number 60-60813.

The armrests (c) of this type of chair (a) are designed in such a manner that, when the chair (a) is at the manufacturing stage, base portions (e) of the armrests (c) are fixed with bolts (f) to a base plate (d) attached to the underside of the seat portion (b), so that the chair is manufactured as a complete assembly with the armrests (c) fixed in place during production, and thus it must be handled as a chair with attached armrests during the pre-shipping storage and transportation stages.

This means that the above-described conventional art of the chair raises the problem that chairs with armrests (c) of many different designs and colors must be manufactured and distributed to answer all requirements, thus increasing the number of types of chair provided by the manufacturer as standard and making manufacturing and storage management more complicated, and this is inevitably expensive.

In view of the above problem, the present invention has as its purpose the provision of a chair that is distributed in a state without armrests, and armrests of different designs and colors can be attached and supplied in answer to customer requests. In addition, the armrests can be attached with a simple operation.

SUMMARY OF THE INVENTION

To solve the problem with the above-described conventional art, the present invention provides a chair with freely attachable and removable armrests, comprising a basic chair unit wherein a leg and a back rest portion are attached to a frame on a lower surface of a seat portion, the two ends of the lower surface in the lateral direction of the seat portion being provided with armrest attachment portions, wherein an attachment end portion provided at the lower end of each armrest comprises a positioning protrusion portion that can be inserted into a positioning hole provided in an internal portion of one of the armrest attachment portions, an attachment base portion positioned and held in close contact with guide surfaces along a guide portion of the armrest attachment portion, and a removal-prevention means in the armrest attachment portion for preventing the removal of the attachment end portion.

When no armrests are attached, the chair is an armless chair comprising a leg, a seat portion, and a back rest portion, and that chair can be supplied as an armless chair, depending on the purpose to which it is used. If armrests are to be attached to the chair, the chair with armrests is assembled by inserting the attachment end portion of each armrest into the corresponding armrest attachment portion on each lateral end of the seat portion, the positioning protrusion portion engages with the positioning hole to determine the insertion position, and also the attachment base portion engages without wobbling, in firm contact with guide surfaces of the attachment portion, and a removal-prevention means locks to prevent the accidental removal of the armrest from the chair. Therefore, by separately supplying armrests of different designs and colors, manufacturers can ensure that different chairs with armrests can be supplied promptly to suit customer requests, simply by selecting the required armrests.

DETAILED DESCRIPTION OF THE PREFERRED EMBODIMENTS

The present invention is described below with reference to the figures attached.

Figure 1:
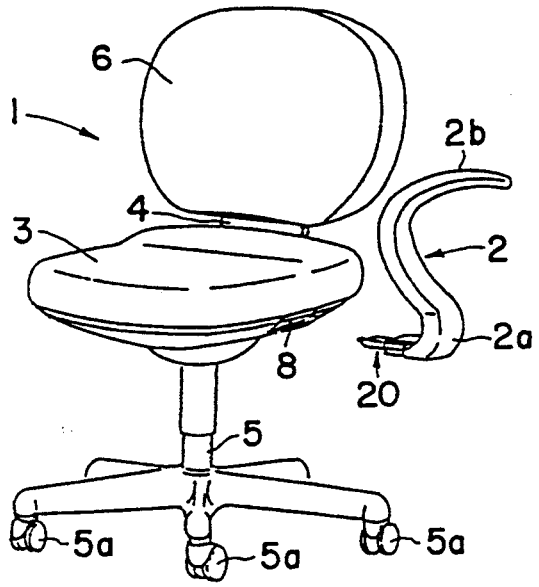
FIG. 1 is a perspective view of the chair of the present invention, with the armrests removed.
Figure 2:
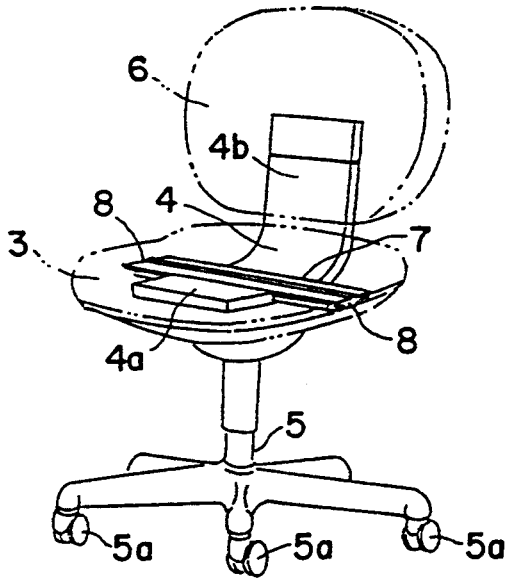
FIG. 2 is a perspective view of the framework of the chair of FIG. 1.

FIG. 1 shows a chair 1 of the present invention with armrests 2 removed, and FIG. 2 shows the framework of the chair 1. The chair 1 is provided with a seat portion 3, a metal frame 4 of an approximately L-shape as seen from the side thereof, and which is provided below the seat portion 3, a leg 5 having casters 5*a* and which is attached to a horizontal portion 4*a* of the frame 4, and a back rest portion 6 attached to a rearward standing portion 4*b* of the frame 4. The horizontal portion 4*a* of the frame 4 is provided with an armrest attachment frame 7 in a direction that crosses the frame 4, and an armrest attachment portion 8 is provided at each end thereof, the armrest attachment portions 8 being arranged to form openings at either side of the lateral direction of the seat portion 3.

Figure 3:
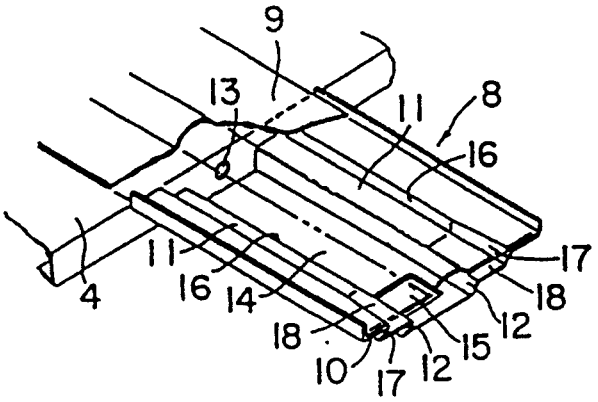
FIG. 3 is a perspective view of one of two armrest attachment portions provided on either side of a seat portion.
Figure 4:
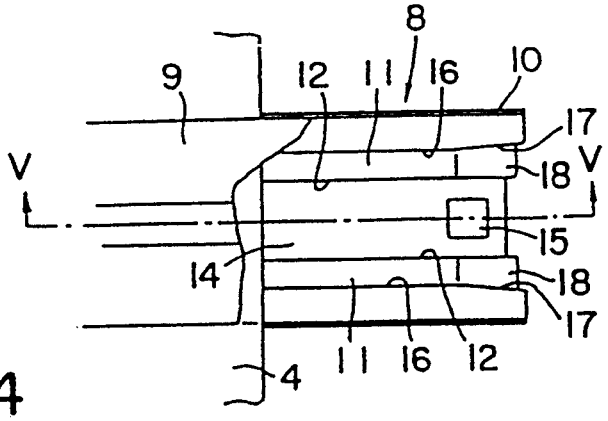
FIG. 4 is a plan view of the armrest attachment portion of FIG. 3.
Figure 5:
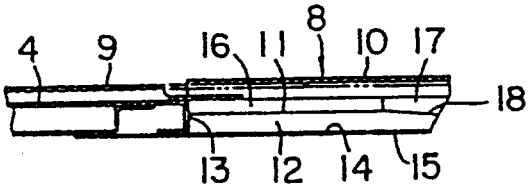
FIG. 5 is a cross-sectional view taken along the line A—A of FIG. 4.

The configuration of each armrest attachment portion 8 is, as shown in FIGS. 3 to 5, of a tunnel-like shape having a space formed of an upper plate 9 and a lower plate 10 into which an attachment end portion 20 of an armrest 2 can be inserted. A longitudinal central portion of the lower plate 10 is indented into a trough portion 12 which is one step lower than bottom surface portions 11 arranged on both sides thereof, to form a guide portion for the attachment end portion 20. A positioning hole 13 is provided bored through the inner end of the trough portion 12, on the side of the armrest attachment frame 7.

A square removal-prevention hole 15 is provided as a removal-prevention means, bored through a base surface 14 close to the open end of the trough portion 12, and tapered guide surfaces 17 are formed in such a manner as to open outward between outer ends of side surfaces 16 at the open end of the trough portion 12. The bottom surface portions 11, which are one step higher than a range that corresponds to the inward directional length of the tapered guide surfaces 17, are formed into tapered guide surfaces 18 that slant downward toward the outside.

Figure 6:
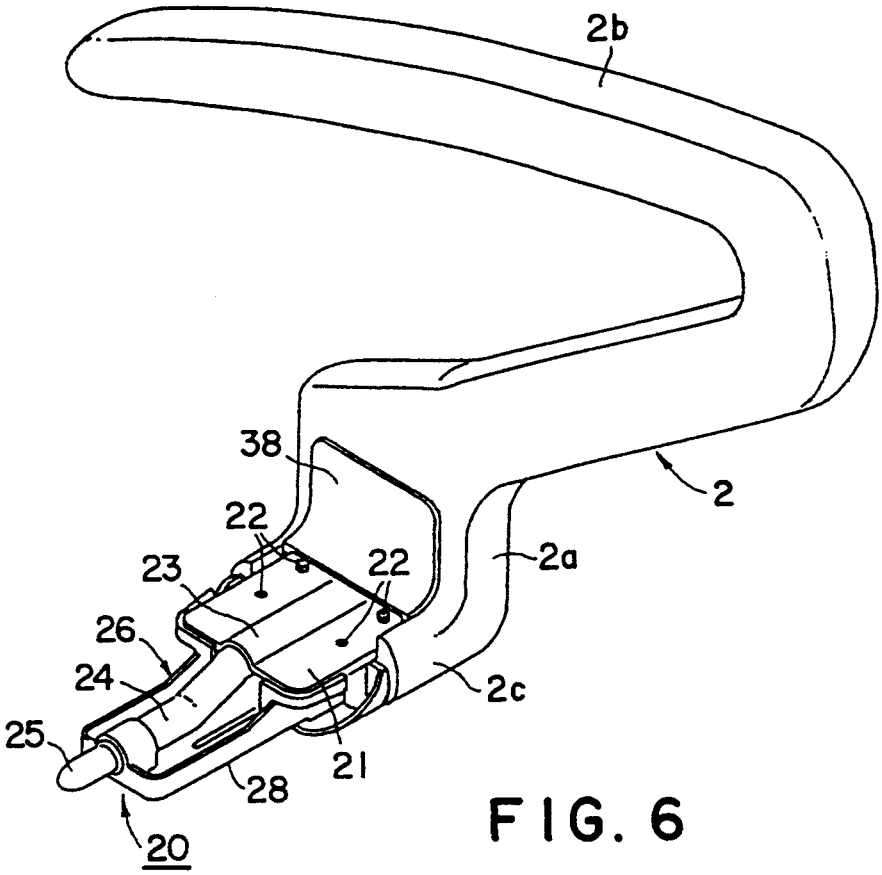
FIG. 6 is a perspective view of a first embodiment of the armrest of the chair of the present invention.
Figure 7:
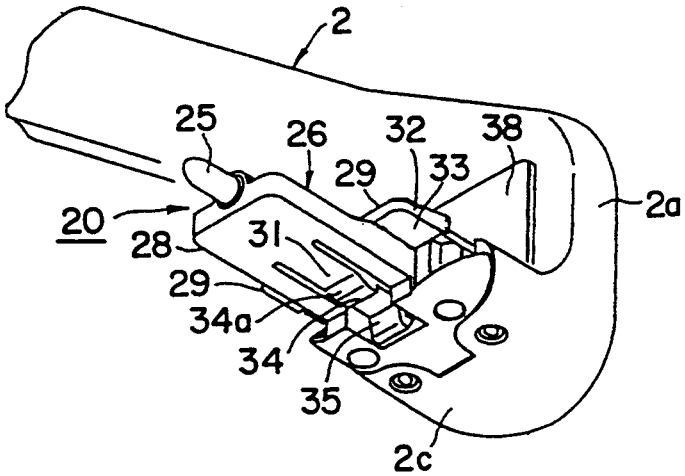
FIG. 7 is a perspective view of the attachment end portion of the armrests of FIG. 6, seen from below.

In this embodiment, each armrest 2 is formed of a material such as a synthetic resin and comprises an elbow rest portion 2*b* that first bends backwards from a portion 2*a* rising from the attachment end portion 20, then extends forward, as shown in FIGS. 1 and 6. In the attachment end portion 20 of the armrest 2, as shown in perspective view from above in FIG. 6, from below in FIG. 7, and in an exploded perspective view in FIG. 8, a metal seating plate 21 of an approximately L-shape as seen from the side thereof is fixed to a lower end portion 2*c* of the armrest 2 by screws 22, the center of a horizontal portion 21*a* of the seating plate 21 is formed into a upwardly protuberant portion 23, a pin portion 24 is fixed by a means such as an adhesive to the under side of the protuberant portion 23, and a positioning protrusion portion 25 is formed at the end thereof.

A spacer 26 that functions as an attachment base portion is attached by screws 27 to the underside of the lower end portion 2*c* of the armrest 2.

This spacer 26 is formed of a synthetic resin and comprises a rectangular insertion portion 28 inserted as tightly as possible into the trough portion 12 of the armrest attachment portion 8, protruding portions 29 extending horizontally on either side of a base portion of the insertion portion 28, and a removal-prevention catch plate 31 formed so as to be free to move vertically in a resilient manner between two parallel slits 30. When the pin portion 24 is inserted into the spacer 26, the positioning protrusion portion 25 is pressed against the end of the spacer 26. The side surfaces of the protruding portions 29 form tapered surfaces 32 that provide a tight connection with the tapered guide surfaces 17 of the side surfaces 16 of the armrest attachment portion 8, and lower surfaces of the protruding portions 29 form tapered surfaces 33 that provide a tight connection with the tapered guide surfaces 18 of the bottom surface portions 11 of the armrest attachment portion 8.

A catch 34 protrudes from the bottom surface near the free end of the removal-prevention catch plate 31, to engage resiliently with the removal-prevention hole 15 when the positioning protrusion portion 25 has been inserted into the positioning hole 13. The forward end surface of the catch 34 is formed as a slanting surface 34*a* in such a manner that, when the spacer 26 is inserted into the lower end portion 2*c*, the catch 34 automatically engages in the removal-prevention hole 15. Reference numeral 35 denotes an operating portion that protrudes from the lower surface of the free end of the removal-prevention catch plate 31, 36 denotes a nut portion for an attachment bolt 37, and 38 and 39 denote concealing covers which are inserted into both the side ends of the rising portion 2*a* so as to cover the attachment bolts 37, 38.

Figure 9:
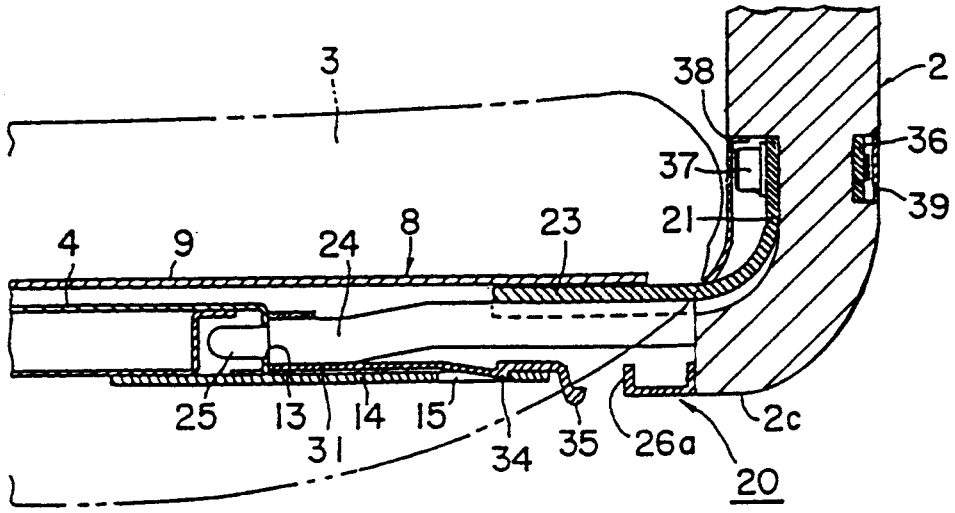
FIG. 9 is a cross-sectional view of the armrest attachment end portion of FIG. 6 inserted into the attachment portion of FIG. 3;.
Figure 10:
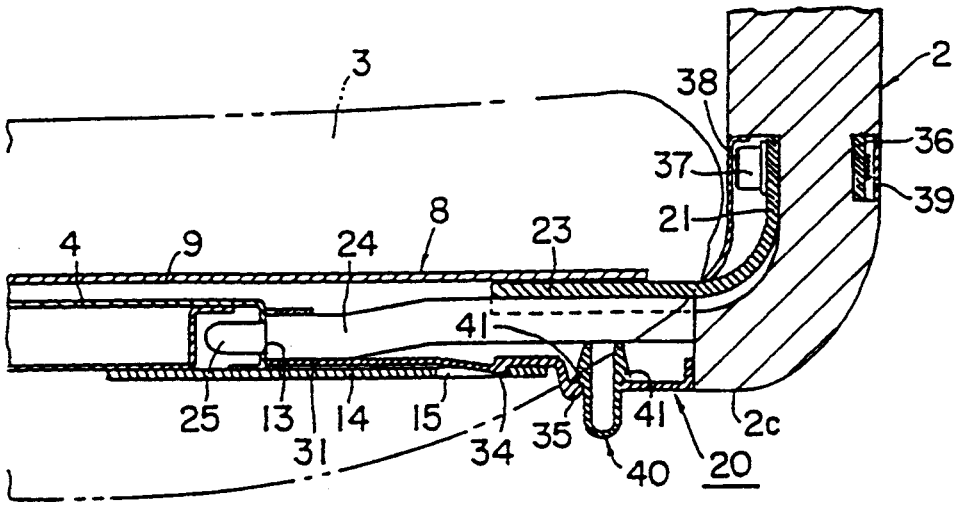
FIG. 10 is a cross-sectional view of a stopper inserted into the armrest attachment portion of FIG. 9.
Figure 11:
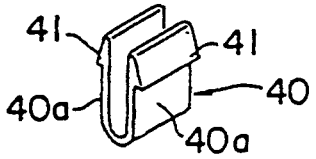
FIG. 11 is a perspective view of the stopper of FIG. 10.

FIGS. 10 and 11 show an embodiment of the present invention that is provided with a stopper 40 to prevent accidental removal of the catch 34. The stopper 40 is formed of a synthetic resin in a U-shape, with return-prevention catches 41 each formed at the external end surface of a leg portion 40*a* thereof, and is freely insertable between the end surface of the operating portion 35 of the removal-prevention catch plate 31 and a rear end portion 26*a* of the spacer 26, shown in FIG. 9, whereupon the inner ends of the return-prevention catches 41 engage to prevent removal in such a manner that the operating portion 35 cannot be pulled out. If the leg portions 40*a* are squeezed together, the return-prevention catches 41 are released and the stopper 40 can be removed.

Figure 12:
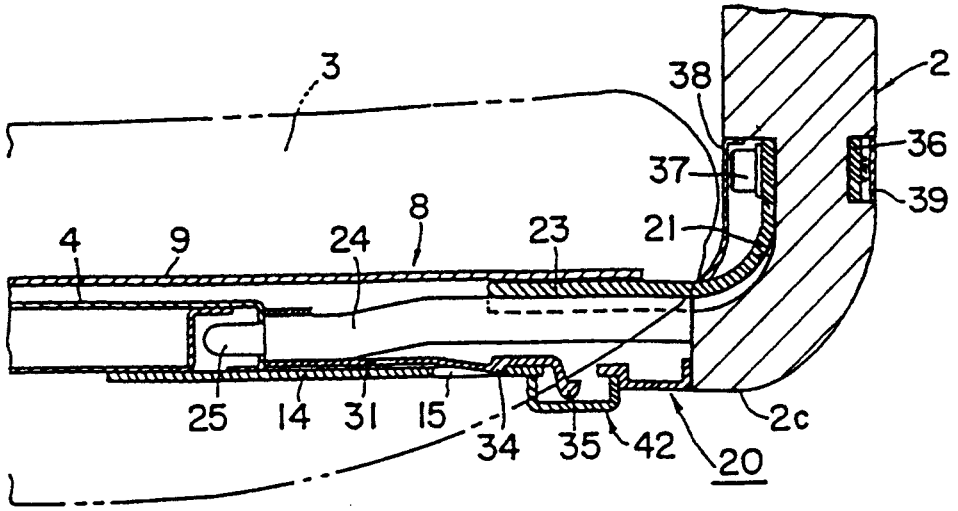
FIG. 12 is similar to FIG. 9, except that a different stopper is inserted.
Figure 13:
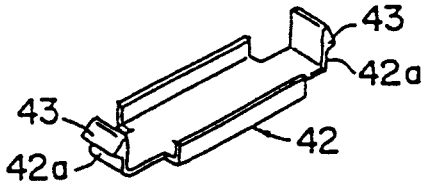
FIG. 13 is a perspective view of the stopper of FIG. 12.

FIG. 12 shows another embodiment of a stopper, different from that of the stopper 40, wherein a stopper 42 is, as shown in FIG. 13, formed as an elongated box shape in a synthetic resin with return-prevention catches 43 protruding from outer end surfaces of end pieces 42*a* rising from the longitudinal ends thereof. The catches are designed to engage with engagement portions (not shown) at the lateral end portions of the spacer 26, so as not to be removed therefrom. In this case, the catch 34 of the removal-prevention catch plate 31 is concealed within the stopper 42, as shown in FIG. 12, so that it cannot be pushed out of the operating portion 35, even if an external force is applied thereto.

Figure 8:
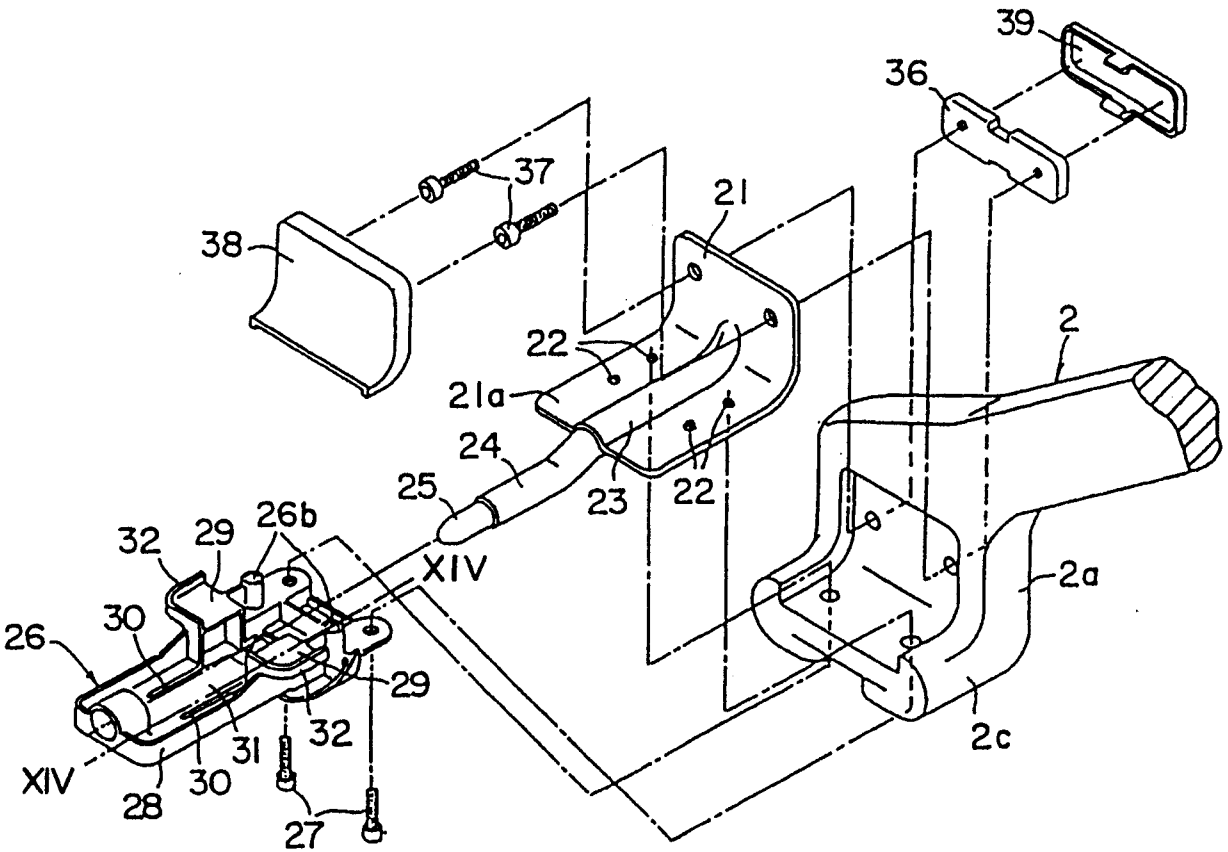
FIG. 8 is an exploded view of the attachment end portion of FIG. 6.
Figure 14:
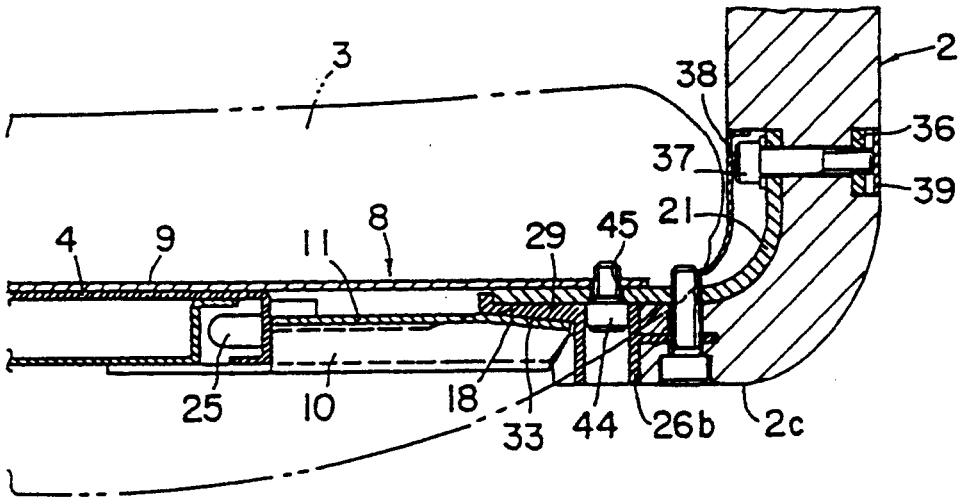
FIG. 14 is an expanded cross-sectional view taken along the line B—B of FIG. 8, illustrating an example of what to do if the removal-prevention catch plate of FIG. 9 should be broken off.

FIG. 14 is a cross-sectional view taken along the line B—B in FIG. 8 to illustrate a screwed-in state wherein the removal-prevention catch plate 31 has been broken off. Screws 44 inserted from tube-shaped portions 26*b* formed on the spacer 26 are screwed into screw holes 45 formed in the upper plate 9 of the armrest attachment portion 8, so that the armrest can be attached even if the removal-prevention catch plate 31 has been lost.

Figure 15:
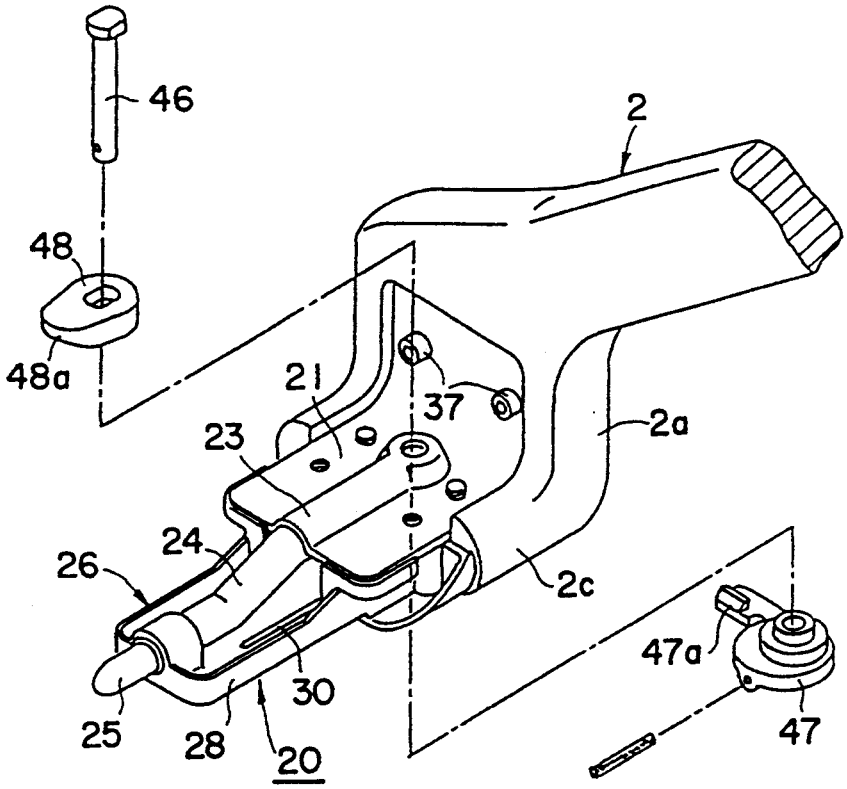
FIG. 15 is an exploded perspective view of another embodiment of a removal-prevention means.
Figure 16:
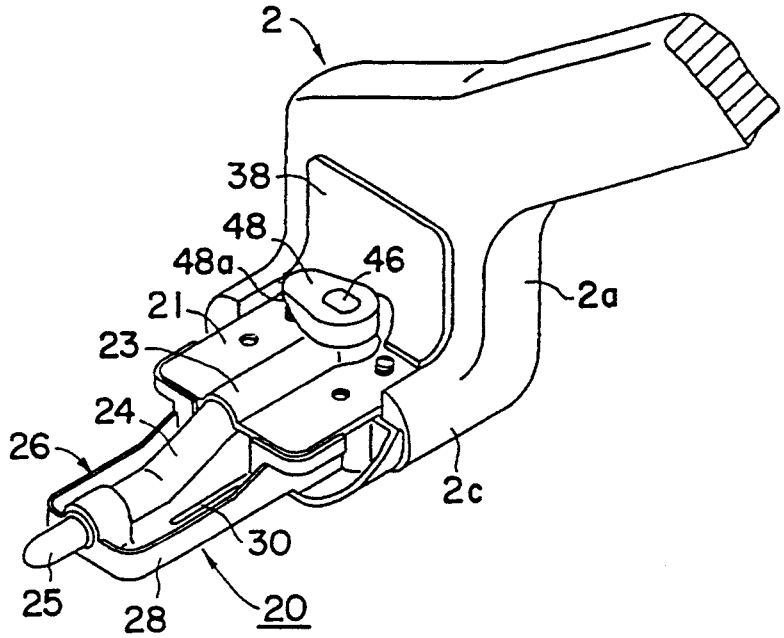
FIG. 16 is a perspective view of the embodiment of FIG. 15.
Figure 17:
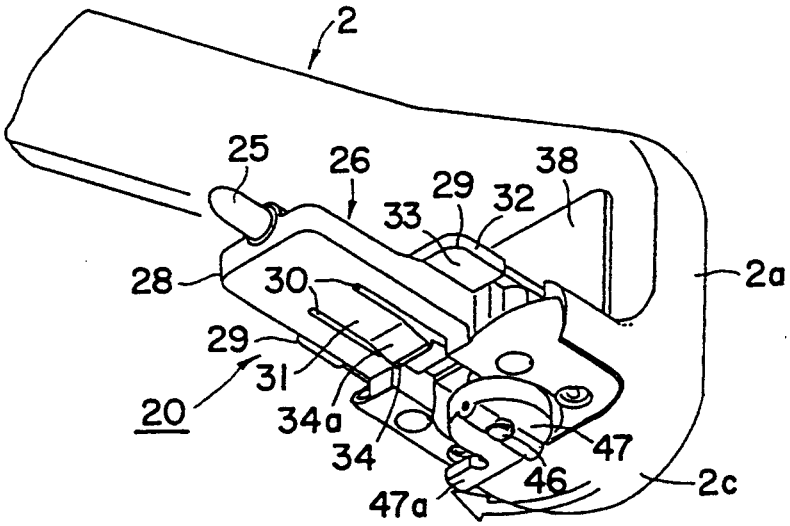
FIG. 17 is a perspective view of the embodiment of FIG. 15, as seen from below.
Figure 18:
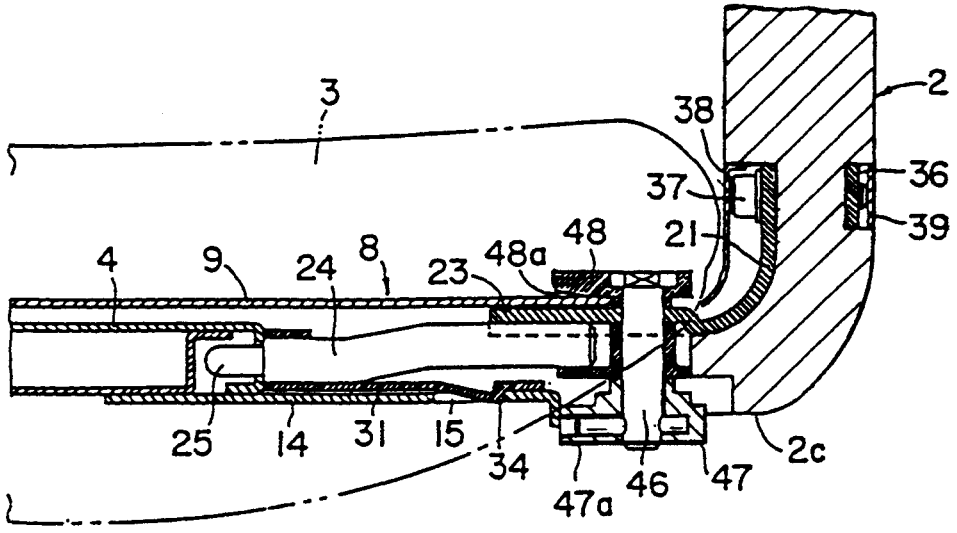
FIG. 18 is a cross-sectional view of the embodiment of FIG. 15, with the locking lever engaged.

FIGS. 15 to 17 show an embodiment wherein the attachment end portion 20 of the armrest 2 is held by a locking lever method. A shaft 46 passing through the seating plate 21 of the attachment end portion 20 is made to be rotatable, a fixing lever 47 is attached to the lower end of the shaft 46, and a fixing catch 48 is attached to the upper end thereof. Rotation of the fixing lever 47 positions a protruding portion 47*a*, which forms part of the peripheral surface of the fixing lever 47, onto the lower plate 10 of the armrest attachment portion 8, without the use of external force, when a slanting surface 48*a* which is the under surface of the fixing catch 48 is pressed against the upper surface of the upper plate 9 of the armrest attachment portion 8, as shown in FIG. 18.

Figure 19:
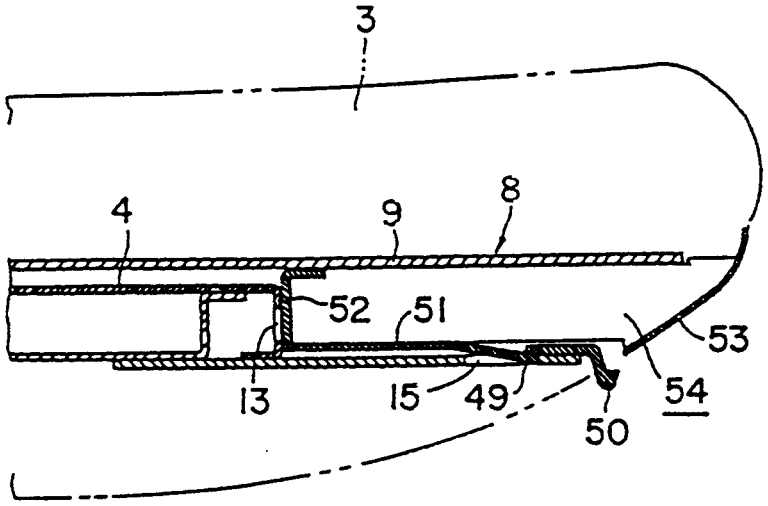
FIG. 19 is a cross-sectional view of the armrest attachment portion when the chair is armless.

FIG. 19 shows an embodiment wherein the chair is used without armrests and the armrest attachment portions 8 are closed off. A catch plate 51 of a construction similar to that of the removal-prevention catch plate 31, with a catch 49 and an operating portion 50, is provided with a stopper portion 52 that strikes against the side surface of the frame 4 and a closing portion 54 formed in one with a closing lid plate 53 at the open end of the armrest attachment portion 8.

The operation of the above embodiments is described below.

With the armrests 2 not attached, the chair 1 is an armless chair formed of the leg 5, the seat portion 3, and the back rest portion 6. When this chair is used as an armless chair, the open end of each attachment portion 8 is closed off by the closing lid plate 53, by inserting the closing portion 54 into the armrest attachment portion 8 so that the catch 49 of the removal-prevention catch plate 51 engages in the removal-prevention hole 15, as shown in FIG. 19. The attachment portion 8 in thus concealed from view from the outside, and the chair can be used without any further modification as an ordinary armless chair.

When the chair is set up to be a chair with armrests, the attachment end portions 20 of the armrests 2 are inserted into the armrest attachment portions 8 that open on either side of the seat portion 3, so that the insertion portion 28 of each spacer 26 that is the attachment base portion of the attachment end portion 20 is inserted into the trough portion 12 of the armrest attachment portion 8. Near the end of this insertion, the positioning protrusion portion 25 is inserted into the positioning hole 13 and, at the same time that the insertion depth is determined, each of the tapered surfaces 32 of the protruding portions 29 of the spacer 26 comes into tight contact with the corresponding tapered guide surfaces 17 and 18 of the armrest attachment portion 8 and is fixed there in such a manner as not to wobble, and also, at the same time, the catch 34 of the removal-prevention catch plate 31 of the spacer 26 engages in the positioning hole 13 and thus the attachment end portion 20 of the armrest 2 is attached in such a manner that it cannot be removed.

If it is desired to make sure that this removal is prevented, the stopper 40 or 42 of FIG. 11 or 13 is inserted so that the operating portion 35 of the removal-prevention catch plate 31 is not forced, so that the armrest 2 cannot be accidentally removed even if an external force should be applied. The engagement between the positioning protrusion portion 25 and the positioning hole 13 and the tight fit between the tapered surfaces 32 and 33 of the spacer 26 and the tapered guide surfaces 17 and 18 of the armrest attachment portion 8 ensure a firm attachment of the elbow rest, without any wobbling.

If it is necessary to remove the armrests 2, each stopper 40 or 42 is removed (if used), the operating portion 35 of the removal-prevention catch plate 31 is pushed in to release the catch 34 from the positioning hole 13, and the attachment end portion 20 of the armrest 2 can then be removed by simply pulling it out.

With the embodiment of FIG. 14, if a single bolt 44 is removed, the armrest 2 can be pulled off. In the embodiment of FIGS. 15 to 18, the fixing catch 48 can be removed from the armrest attachment portion 8 by rotating the fixing lever 47 through 90°, and once this fixing has been released, the armrest 2 can be pulled off.

Figure 20:
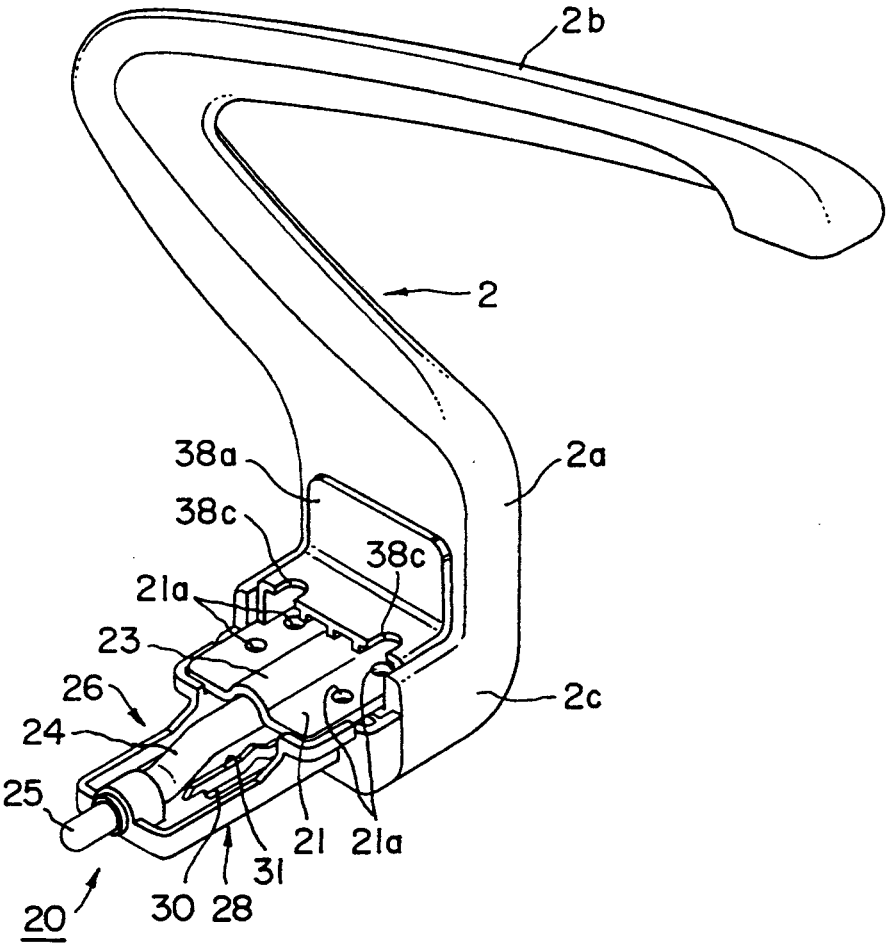
FIG. 20 is a perspective view of a second embodiment of the armrest of the chair of the present invention.
Figure 21:
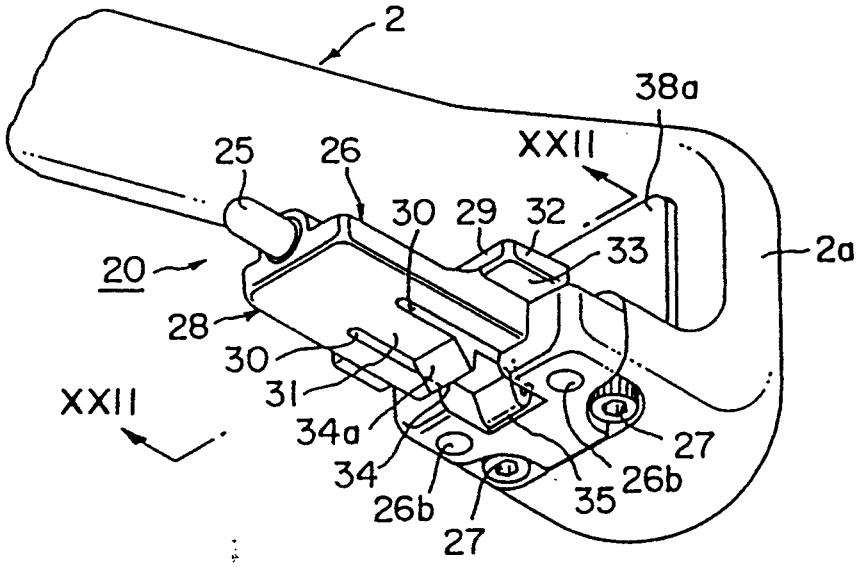
FIG. 21 is a perspective view of the attachment end portion of the armrest of FIG. 21.
Figure 22:
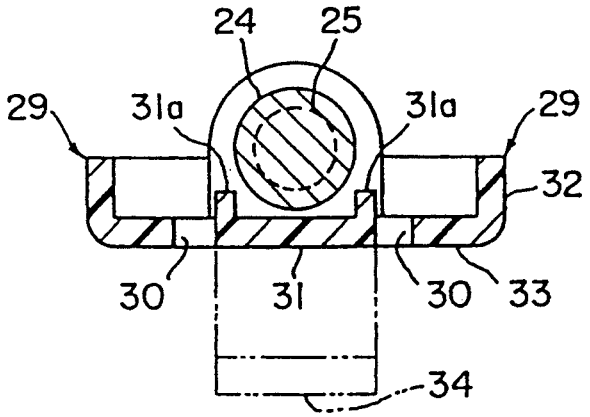
FIG. 22 is a cross-sectional view taken along the line C—C of FIG. 21.
Figure 23:
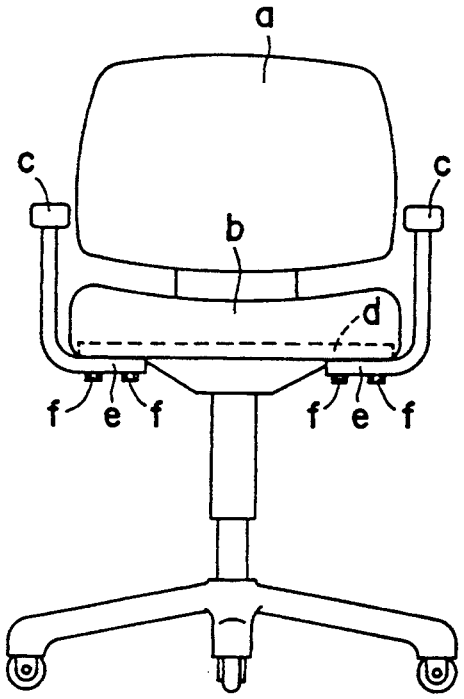
FIG. 23 PRIOR ART
FIG. 23 is a front view of a chair of the conventional art.

In addition, as shown in FIGS. 20, 21 and 22, as a second embodiment of the armrest of the chair of the present invention, reinforcement ribs 31*a* are provided at both the outer sides of the removal-prevention catch plate 31 and the screws 27 are engaged with screw holes 21*a* formed in the metal seating plate 21 so as to fix the spacer 26 with the lower end portion 2*c* of the armrest 2. Notches 38*c* are formed on the concealing cover 38*a* to avoid to contact the top ends of the screws 27 therewith.

With the above configuration, armrests of different designs, colors, and materials can be provided separately, so that any necessary number of chairs with armrests can be shipped immediately in answer to orders, simplifying storage management. In addition, the shape of the armrests is not limited to the shape shown in the diagrams; a loop shape could be selected, or any desired shape could be selected as part of the design of the chair.

As described above, the present invention ensures that chairs comprising just a seat portion and a back rest portion can be distributed, but they can be supplied as chairs with armrests by simply attaching armrests to suit the customers' requirements. The retailer's stocks can therefore be reduced to just sample products and thus manufacturing and storage management can be simplified, so that this chair has the huge advantage that storage space and costs are reduced. The attachment of each armrest can be done by inserting an attachment end portion of the armrest into an attachment portion that opens at the end of one side of the seat portion, so that the attachment can be simplified. Another effect of the present invention is the way that the attachment, or rather the metal assembly between the attachment portion and the attachment end portion, can withstand forces so that it is not inferior from the strength point of view, and moreover the armrest attachment end portion is held by guide surfaces so that the elbow rest does not wobble, and thus the feel of the chair in use is similar to that of a chair with armrests held by conventional bolt means.

What is claimed is:

1. A chair with freely attachable and removable armrests, comprising, a basic chair unit including a seat portion, a frame on a lower surface of said seat portion, a leg and a back rest portion attached to said frame;

two armrest attachment portions located on said lower surface of said seat portion, each of said armrest attachment portions having an insertion opening, a guide portion, and inner end portion, said insertion opening facing in a direction which is lateral relative to the seat portion, said guide portion having guide surfaces which extend from said insertion opening in an insertion direction, said inner end portion being transverse to said insertion direction and defining a positioning hole which is smaller than said insertion opening;

an armrest with a lower end provided with an attachment end portion, said attachment end portion including a positioning protrusion which is insertable into said positioning hole, said attachment end portion also including an attachment base portion which is positioned and held in close contact with said guide surfaces of said armrest attachment portion; and, a removal-prevention means provided in said armrest attachment portion for preventing the removal of said attachment end portion.

2. The chair according to claim 1, wherein said attachment base portion comprises a spacer having a rectangular insertion portion tightly inserted into a trough portion of said armrest attachment portion, with a protruding portion extending horizontally on either side of a base portion of said rectangular insertion portion, and a removal-prevention catch plate formed so as to be free to move vertically in a resilient manner between two parallel slits formed in said spacer.

3. The chair according to claim 1, wherein said removal-prevention means comprises a removal-prevention catch plate which has a free end, a bottom surface, and a a catch which protrudes from the bottom surface near the free end of said removal-prevention catch plate to engage resiliently with a removal-prevention hole bored through a base surface of said armrest attachment portion.

4. The chair according to claim 1, wherein the removal-prevention means has a rear end portion, and a stopper is provided to be freely insertable between the rear end portion of said removal-prevention means and an end surface of a portion of said attachment base portion so as to prevent accidental disengagement of a removal-prevention catch plate from the armrest attachment portion.

5. A chair with freely attachable and removable armrests, comprising, a basic chair unit including a seat portion, a frame on a lower surface of said seat portion, a leg and a back rest portion attached to said frame;

two armrest attachment portions located on said lower surface of said seat portion, each of said armrest attachment portions having an insertion opening, a guide portion, and inner end portion, said insertion opening facing in a direction which is lateral relative to the seat portion, said guide portion having guide surfaces which extend from said insertion opening in an insertion direction, each said armrest attachment portion having said inner end portion with a positioning hole formed therein;

an armrest with a lower end provided with an attachment end portion, said attachment end portion including a positioning protrusion which is insertable into said positioning hole, said attachment end portion also including an attachment base portion which is positioned and held in close contact with said guide surfaces of said armrest attachment portion;

said attachment base portion including a spacer having a rectangular insertion portion having a base portion and being tightly inserted into said armrest attachment portion, with a protruding portion extending horizontally on either side of said base portion; and, a removal-prevention means provided in said armrest attachment portion for preventing the removal of said attachment end portion, said removal prevention means including a removal-prevention catch plate formed so as to be free to move vertically in a resilient manner between two parallel slits formed in said spacer.

6. A chair with freely attachable and removable armrests, comprising, a basic chair unit including a seat portion, a frame on a lower surface of said seat portion, a leg and a back rest portion attached to said frame;

two armrest attachment portions located on said lower surface of said seat portion, each of said armrest attachment portions having an insertion opening, a guide portion, and inner end portion, said insertion opening facing in a direction which is lateral relative to the seat portion, said guide portion having guide surfaces which extend from said insertion opening in an insertion direction, each said armrest attachment portion having said inner end portion with a positioning hole formed therein;

an armrest with a lower end provided with an attachment end portion, said attachment end portion including a positioning protrusion which is insertable into said positioning hole, said attachment end portion also including an attachment base portion which is positioned and held in close contact with said guide surfaces of said armrest attachment portion; and, a removal-prevention means provided in said armrest attachment portion for preventing the removal of said attachment end portion, said removal-prevention means having a rear end portion, and a stopper which is freely insertable between the rear end portion of said removal-prevention means and an end surface of a portion of said attachment base portion so as to prevent accidental disengagement of a removal-prevention catch plate from the armrest attachment portion.

* * * * *